US005403979A

United States Patent [19]

Rogers et al.

[11] Patent Number: 5,403,979

[45] Date of Patent: Apr. 4, 1995

[54] EASILY RAISABLE AND LOWERABLE TELESCOPIC SHELL TOWER ACOUSTIC SYSTEM AND METHODS OF MAKING AND USING THE SYSTEM

[75] Inventors: Orley D. Rogers, Farwell, Mich.; James F. Jenne, Palos Verdes, Calif.

[73] Assignee: StageRight Corporation, Clare, Mich.

[21] Appl. No.: 128,346

[22] Filed: Sep. 28, 1993

[51] Int. Cl.[6] ..... E04B 1/99; E04B 1/343

[52] U.S. Cl. ..... 181/30; 181/287; 181/296

[58] Field of Search ..... 181/30, 285, 287, 292, 181/295, 296

[56] References Cited

U.S. PATENT DOCUMENTS 2,671,242 3/1954 Lewis .
3,007,539 11/1961 Brewer et al. .
3,180,446 4/1965 Wenger .
3,232,370 2/1966 Jaffe .
3,435,909 4/1969 Wenger et al. .
3,630,309 12/1971 Wenger et al. .
3,908,787 9/1975 Wenger et al. .
3,975,850 8/1976 Giaume .
4,108,455 8/1978 James .
4,278,145 7/1981 Eade et al. .
5,069,011 12/1991 Jenne .
5,168,129 12/1992 D'Antonio .

*Primary Examiner*—Richard A. Wintercorn
*Assistant Examiner*—Eddie C. Lee
*Attorney, Agent, or Firm*—Learman & McColloch

[57] ABSTRACT

An acoustic shell tower module of sound enhancing character assemblable with other such towers to form an orchestral shell, has a first sound enhancing panel mounted on a generally horizontally rearwardly extending counterweighting base. A second sound enhancing panel is mounted for vertical telescoping movement from a storage position, generally horizontally aligned with the first panel, upwardly to a raised position in which it extends above the first panel to form a sound reflecting and enhancing upper extension thereof, and a system is provided for easily raising and lowering the second panel and retaining it in raised position.

20 Claims, 5 Drawing Sheets

FIG-1
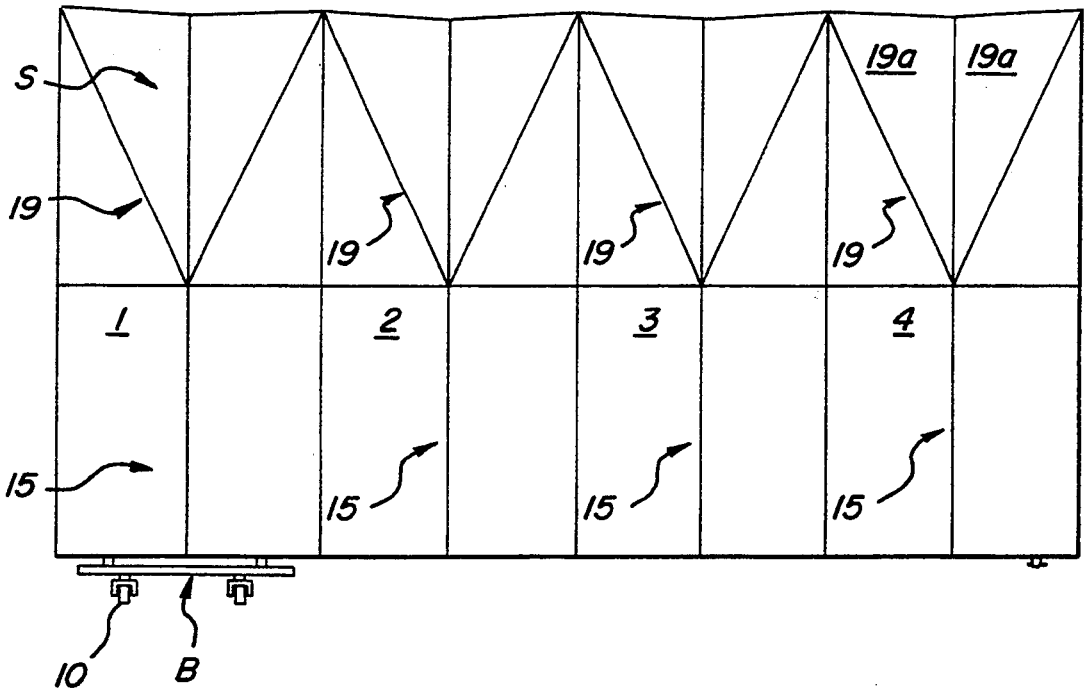
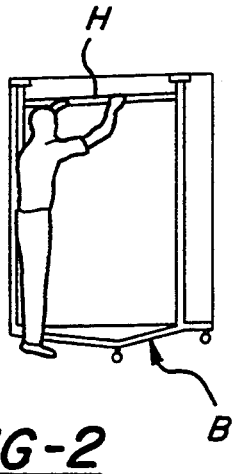
FIG-2
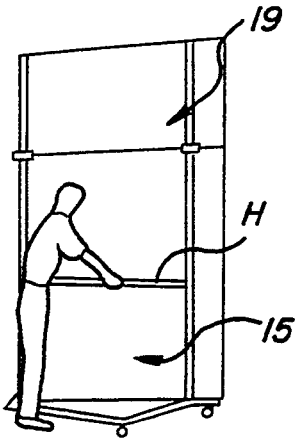
FIG-3
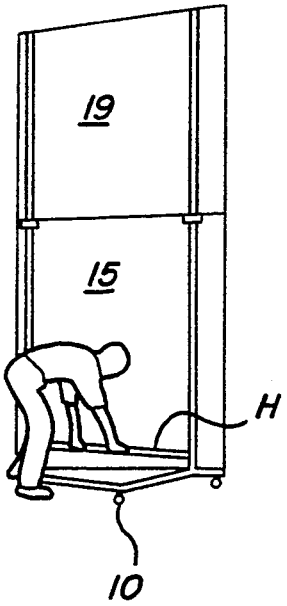
FIG-4

10
11
12
14
15
16
18
19
19a
19b
20
21
22
25
26
B
H

EASILY RAISABLE AND LOWERABLE TELESCOPIC SHELL TOWER ACOUSTIC SYSTEM AND METHODS OF MAKING AND USING THE SYSTEM

BACKGROUND OF THE INVENTION

This invention relates to raisable and lowerable, self-standing, sound reflective shell tower modules and systems of the type used on stage to enhance the performance of orchestras, bands, choruses, dramatic groups and the like. Typically such towers are comprised of a plurality of panel modules which are placed in side by side abutting relation to provide a shell structure in conjunction with overhead sound reflective ceilings, or without them.

The following listed patents, which are incorporated herein by reference, disclose various structures which are known to us:

U.S. Pat. No. 2,671,242 Lewis
U.S. Pat. No. 3,007,539 Brewer et al
U.S. Pat. No. 3,180,446 Wenger
U.S. Pat. No. 3,232,370 Jaffe
U.S. Pat. No. 3,435,909 Wenger et al
U.S. Pat. No. 3,630,309 Wenger et al
U.S. Pat. No. 3,975,850 Giaume
U.S. Pat. No. 3,908,787 Wenger et al
U.S. Pat. No. 4,108,455 James
U.S. Pat. No. 4,278,145 Eade et al
U.S. Pat. No. 5,069,011 Jenne
U.S. Pat. No. 5,168,129 D'Antonio One of the difficulties with prior art structures, which have been of a relatively complex nature, has been the time and effort required to set up these older style shells. The present invention is conceptualized to remove the weight of the raisable panel as a deterrent to persons of slight build and strength raising it into operative position, while, at the same time, providing rigid, multifaceted panels which blend and mix sounds to enhance the music for both the performers and audience.

SUMMARY OF THE INVENTION

The present invention contemplates a shell structure comprising shell modules consisting of a lower panel mounted on a base which can be rolled to and from an assembly position, and at least one raisable panel which is mounted for vertical telescoping movement from a demounted position, in which the module will readily pass through standard doorways, to a raised position extending sufficiently above the lower panel to provide the height required for the module to function as one tower of an operative acoustic shell which mixes and diffuses the sound. Preferably, a handle crossbar, connected to counterweights which substantially exactly balance the weight of the raisable panel, is depressable with very little effort to elevate the raisable panel and is infinitely adjustable to positions in which it will be automatically retained in position.

One of the prime objects of the present invention is to provide an improved shell tower panel structure of the character described which can be readily assembled in modules consisting of lower panels and raisable and lowerable upper panels to form an optimal acoustical shell which reinforces and blends the sound projected toward the audience, while also enhancing the ability of the musicians to hear themselves and adjust their performance accordingly.

A further object of the invention is to provide a sound mixing and distributing acoustic shell formed of free standing tower modules which, because of the telescoping height adjustment which is possible, will pass through standard doorways and may be set up in rooms having low ceilings at any height within the range of telescopic movement of the upper panel.

Still another object of the invention is to provide a simply constructed non-complex tower module of the character described which can provide the sound mixing effect which is desirable.

Still another object of the invention is to provide a shell tower module system which, while utilizing sound reflective materials in its construction, is relatively strong and durable.

Still another object of the invention is to provide a shell tower system of the type described wherein the telescoped individual modules can be very conveniently compactly stored in nested position.

Other objects and advantages of the invention will become apparent with reference to the accompanying drawings and the accompanying descriptive matter.

BRIEF DESCRIPTION OF THE DRAWINGS

FIG. 1 is a schematic perspective front elevational view of a music shell system formed of four modules constructed according to the present invention which are disposed in edge abutting relation, the casters on the various modules, except for the end casters, being only fragmentarily illustrated in the interest of convenience;

FIG. 2 is a schematic perspective elevational view showing a module in a storage position in which the upper and lower panels are generally in horizontal alignment;

FIG. 3 is a similar view showing the modules in a position in which the upper panel has been partially raised;

FIG. 4 is a view showing the module in a configuration in which the upper panel is fully elevated;

DETAILED DESCRIPTION OF THE PREFERRED EMBODIMENT

Figures 5, 6, 7:
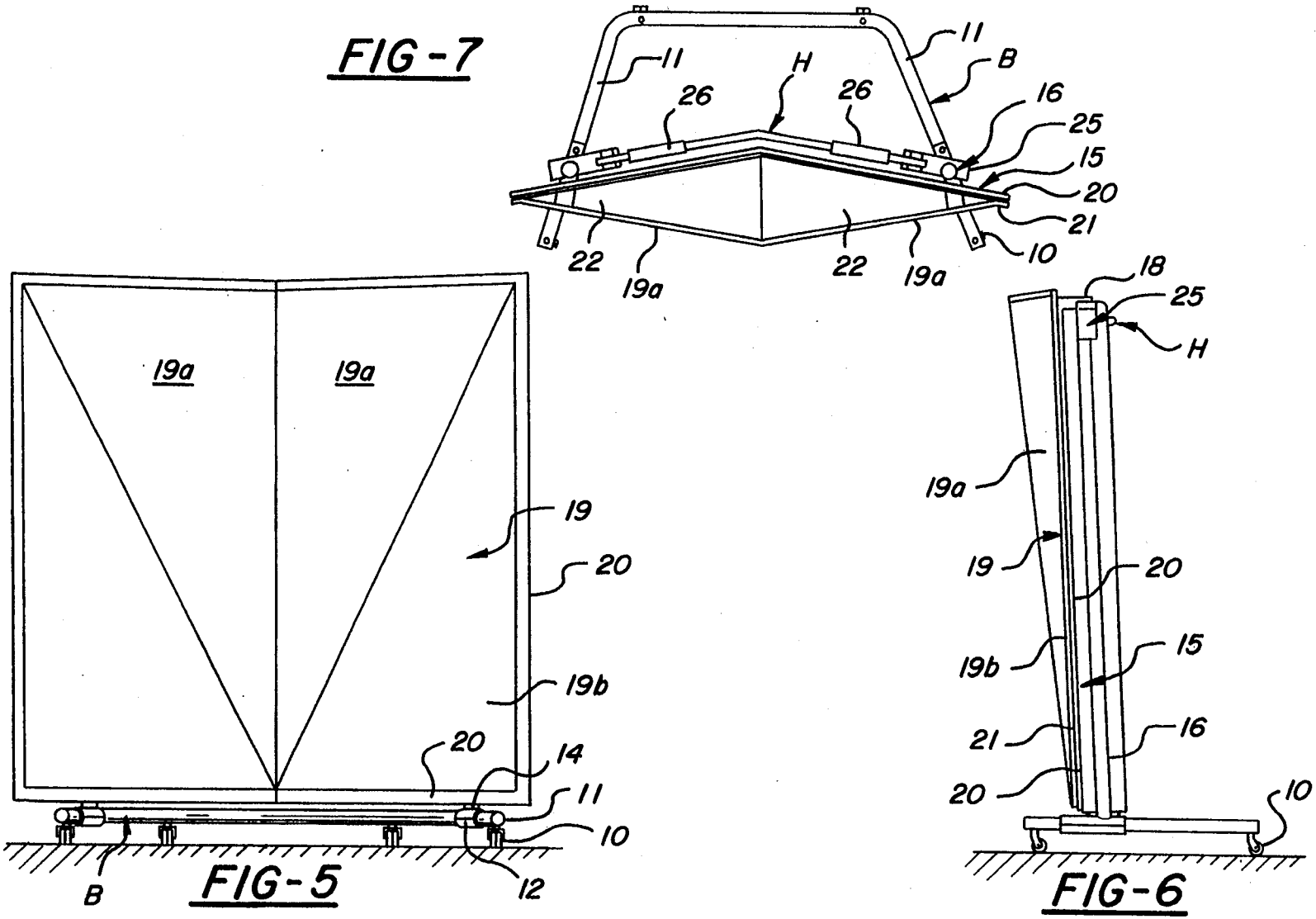
FIG. 5 is a schematic, front elevational view of one of the tower modules with the raisable panel in lowered position.
FIG. 6 is a schematic end elevational view thereof.
FIG. 7 is a schematic top plan view thereof.

Referring now more particularly to the drawings and in the first instance particularly to FIG. 1, it will be noted that an orchestral shell system, generally designated S, is shown as made up of tower modules 1, 2 3, and 4 which are constructed according to the present invention, the modules being disposed in edge to edge abutting relation as shown to form a shell which, in plan, is shallowly concave as it faces an audience. As FIGS. 7 and 8 particularly illustrate, each of the identical modules 1, 2, 3 and 4 includes a generally U-shaped base generally designated B, supported for rolling transport movement at front and rear by, preferably, twin caster wheel assemblies 10. On each side rail 11 of the base B, a split collar 12 is anchored to the rail 11, as with bolts 13, to support a tubular post 14. A lower panel, which may generally be designated 15 and functions as a rear panel when the module is in a knocked down, storage condition, is fixed to the posts 14 as shown and counterweighted by the base B. As FIG. 7 particularly indicates, the fixed panel 15 is of shallowly V-shaped configuration and may be described as of shallowly concave configuration.

Figure 8:
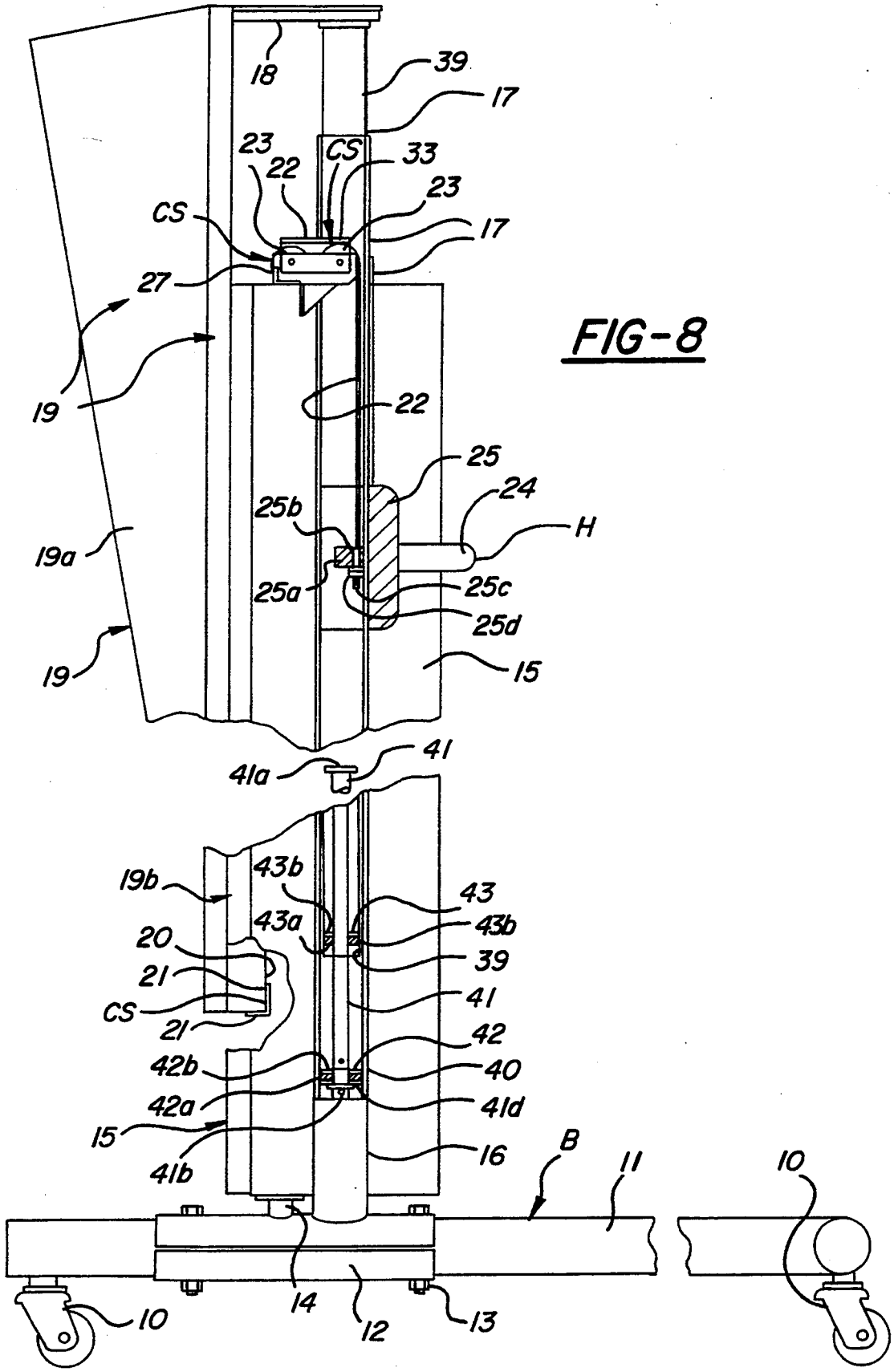
FIG. 8 is a partly sectional, schematic, end elevational view illustrating various operating parts of the shell tower and showing the upper panel in a partly raised position.

Also supported by each sleeve 12 on the base B, rearward of each post 14, is a fixed tubular mast 16, which is open at its upper end as at 16*a*, as shown in FIG. 8, to receive a telescoping support and guide tube assembly, generally designated 17. Each telescoping assembly 17 is connected by a bridging bracket 18 to a raisable upper panel, generally designated 19, which may also be referenced as the front panel. As the top plan view FIG. 7 particularly indicates, each panel 19 has protrudent sound reflecting and mixing projections 19*a* of generally inversely triangular configuration forming a shallowly convex configuration of downwardly divergent character above the flat lower portion 19*b* of the panel 19. The panels 15 and 19 are formed of sound reflective acoustic material. This may include suitable polystyrene foam core panels, with ABS plastic skins, received by aluminum channel edge members 20 along all edges.

The front panel 19 may be manually raised by a cable and pulley system, generally designated CS, which includes a pair of cables 22, each passing over a set of pulleys 23 and securing to the lower end of the front panel 19 as at 21. At their opposite ends, the cables 22 secure to counterweights, generally designated 25 (see FIG. 8), which have forwardly extending projections 25*a* with openings 25*b* to pass the cables which have threaded ends 25*c* secured by nuts 25*d*. The counterweights 25 comprise a counterweight system and are connected by a handle, generally designated H, which may have handle grips 26 secured thereon.

Figure 10:
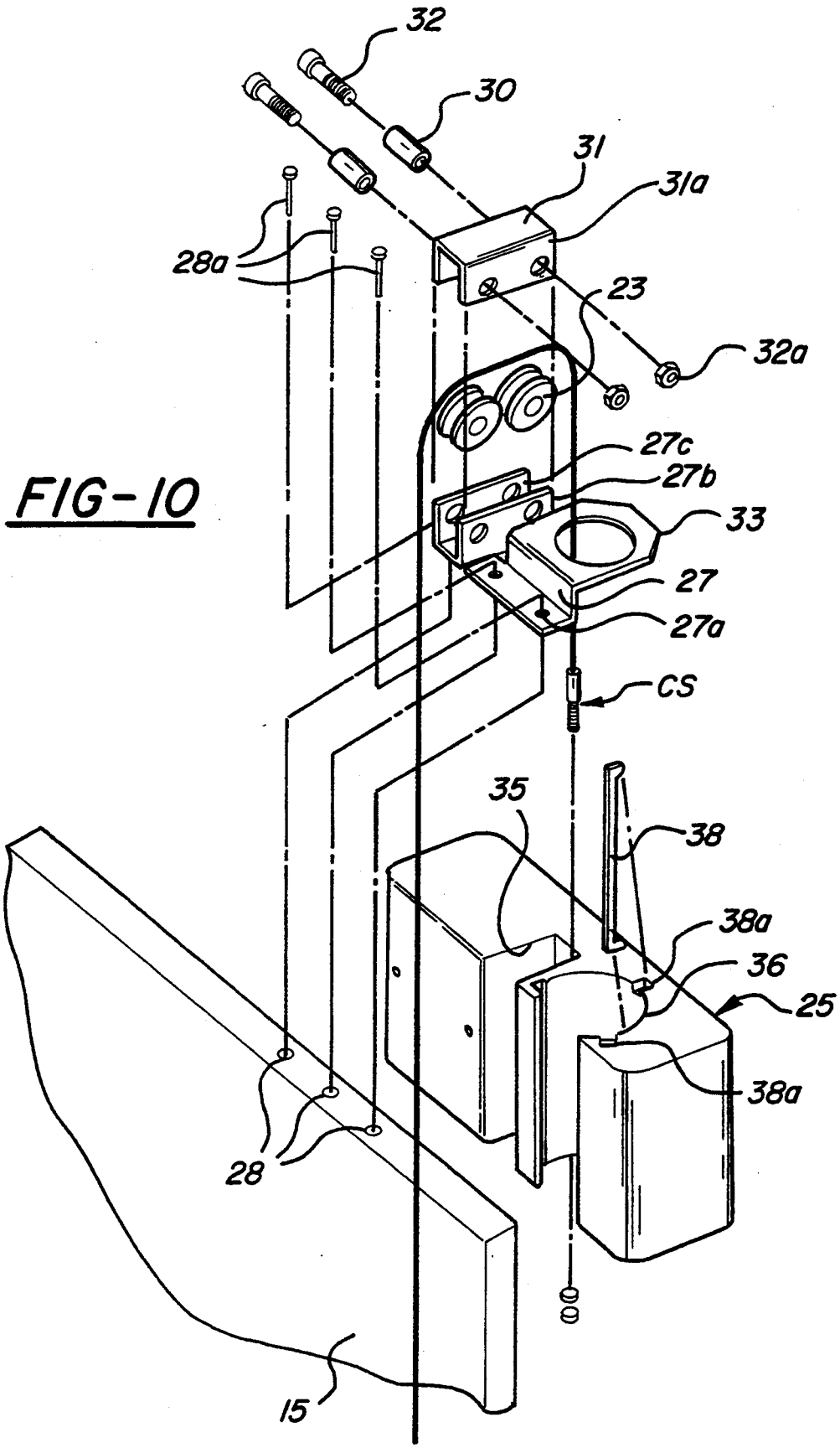
FIG. 10 is an enlarged exploded, schematic, perspective elevational view of certain operating parts which are shown in FIG. 9.

Brackets 27, for supporting the pulleys 23, as shown more particularly in FIG. 10, secure to the upper end of the panel 15, the brackets 27 having openings 27*a* permitting them to be secured by suitable screws 28*a* extending into openings 28 provided in the panel 15. The brackets 27 further have upstanding plates 27*b*, with openings 27*c*. Bushings 30 are provided for the rotatable pulleys, the pulleys being protected by a pulley cover plate 31 with openings 31*a* aligning with the openings 27*c*. The bracket assembly further includes bolt fasteners 32 which pass through the openings 31*a*, bushings 30, and openings 27*c*, and nuts 32*a* for retaining them. As FIG. 10 further discloses, the pulley support brackets 27 include rearwardly extending plate portions 33, with openings 34 through which the upper ends of mast 16 extend to maintain the plumb of the masts and panel 15.

It will be noted that each of the counterweights 25 is recessed as at 35 (FIG. 10) to receive the cables 22, and is further generally cylindrically vertically slotted as at 36 to receive the masts 16 and guide thereon in up and down movement. To facilitate aligned sliding movement, the counterweights 36 are provided with slots 38*a* for receiving linear weight glide bushings 38 which mount in slots 38*a* provided in the masts 16. Two or three such slots 38*a* and glides 38 may be provided.

The telescopic guide assembly 17 includes, for each mast 16, an inner tube, generally designated 39, fixed to the bracket 18, a mid-tube, generally designated 40, and a plunger assembly, generally designated 41 which telescopically connects each mid-tube 40 with an inner tube 39. The mid-tubes 40 are slidably received within the tubular masts 16, the inner tubes 39 are slidably received within the mid-tubes 40, and the plungers 41 are received within the inner tubes 39 and extend down through them into the mid-tubes 40. The masts 16 function as a guide system for the raisable panel 19.

Mounted on the lower end of each plunger 41 is a washer 41*a* retained by a pin 41*b*. Above it a mid-tube washer assembly 42 is fixed to the interior wall of the mid-tube 40 and may comprise a steel washer 42*a* with rubber pads 42*b* at top and bottom. An inner tube washer 43 is similarly fixed within each inner tube 39 and may comprise a steel washer 43*a* with a top rubber pad 43*b*.

When the tubes 39 are drawn upwardly by upward movement of the brackets 18, the tubular members 39 move upwardly within tubes 40 to the extent permitted. Thereafter the washers 43 engage the heads 41*a* of plungers 41 and, with plungers 41 engaging washers 42, pull the mid-tube members 40 upwardly to the extent permitted.

Figure 9:
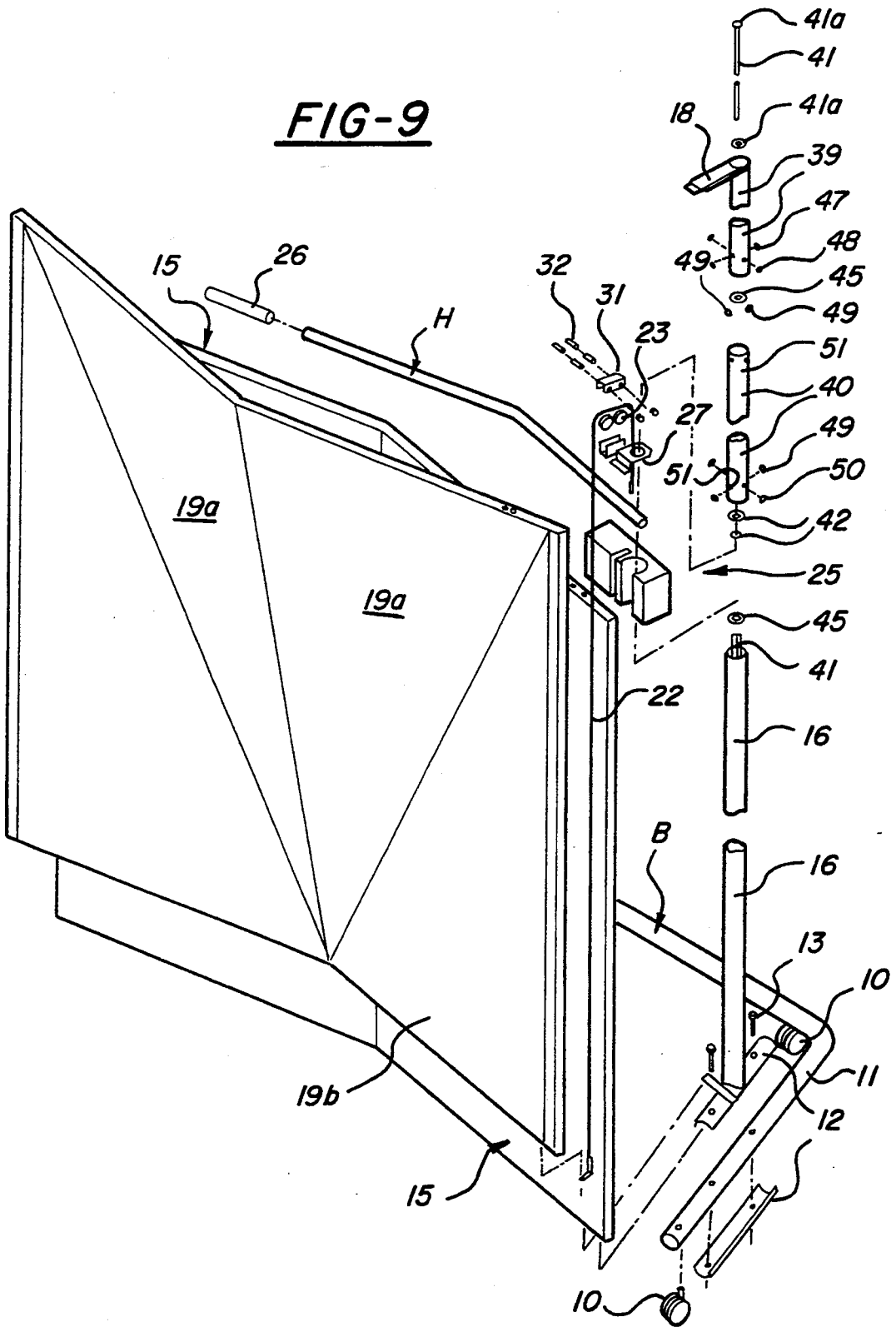
FIG. 9 is an exploded, schematic, perspective elevational view illustrating various operating parts in considerable detail.

Some of the detail which is involved in the telescopic assembly, although not necessary to an understanding of its operation, is disclosed in the exploded view FIG. 9. In the lower end of masts 16, cushioning pads 45 are shown, as FIG. 8 best discloses, to absorb any shock and minimize noise created when the mid-tube assembly 40 comes into contact with it. It will be observed, further, that the inner tubes 39 are provided with openings 46 to receive glide buttons 47 which protrude slightly therefrom to facilitate sliding movement of the inner tubes 39. These glide bushings or buttons 47 may be spaced relatively to the tubes 39 by washers 48. Similar glide bushings 49 spaced by washers 50 can be received in openings 51 provided in the mid-tubes 40 for the same purpose.

THE OPERATION

In operation, and referring in the first instance to FIGS. 2–4, it will be seen that the handlebar H is in its raised position when the panels 15 and 19 are substantially in horizontal alignment in the storage position illustrated in FIG. 2. As shown in FIG. 3, to fully raise the upper panel 19, the erector need only push the handle H downwardly through the FIG. 3 position, and then through to the FIG. 4 position. In so doing, the forces of gravity aid the music shell erector. Because the weights 25 counterbalance the weight of the panel 19, it is a relatively easy maneuver to raise the upper panel 19 to the extent desired. The telescopic assembly 17 of course is telescopically extended by the raising movement of the brackets 18 fixed to panel 19 to provide the desired guiding support. To lower the upper panel 19, it is only necessary to pull upwardly on the handle 24 which, because it is counterbalanced by the weight of the upper panel 19, will render lowering of the panel 19 a comparatively easy task.

To set up the shell system disclosed in FIG. 1, the respective modules 1, 2, 3, and 4 are, of course, rolled to the abutting relation in which they are shown in FIG. 1, after which it is a relatively easy task as indicated to raise their upper panels 19 to the extent desired. In low ceiling rooms they will, of course, not be completely raised. It is again to be emphasized that the counterbalance system which has been disclosed retains the upper panel 19 automatically in any position to which it is elevated.

It is to be understood that the embodiments described are exemplary of various forms of the invention only and that the invention is defined in the appended claims which contemplate various modifications within the spirit and scope of the invention.

I claim:

1. In an easily raisable and lowerable acoustic shell tower system which is assemblable with other such towers to form an orchestral shell, the combination comprising:

(a) a sound shell tower panel assembly having a first panel with front and rear surfaces and sound reflecting and enhancing construction;

(b) said assembly including a generally horizontally extending base mounted to and counterweighting said first panel;

(c) stage engaging supports for said assembly mounted on said base;

(d) a second sound shell upper panel having sound reflecting and enhancing configuration and construction, mounted on said base for vertical sliding planar movement parallel to said first panel from a storage position generally horizontally aligned with said first panel upwardly to a raised position in which said second panel extends above said first panel to form a sound reflecting and enhancing upper extension thereof; and (e) a guide system for retaining said second panel in parallelism with said first panel as said second panel moves to and from raised position.

2. The tower of claim 1 wherein said second panel is in front of the first panel when the first and second panels are in generally horizontally aligned position.

3. The tower of claim 2 wherein said second panel has forwardly projecting, multifaceted sound blending sections.

4. The tower of claim 3 wherein said front surface of said first panel has a generally concave configuration.

5. The tower of claim 1 wherein said guide system includes upstanding tubular masts with open upper ends mounted on said base rearwardly adjacent said first panel, and telescopic members are received in each of said masts to extend above the masts, and bridge structure extends from said telescopic members over said first panel and connects to said second panel.

6. The tower of claim 5 wherein said first and second panels have upper and lower ends, a pulley system is supported on said first panel near the upper end of said first panel, and a cable system connected to the lower end of said second panel leads over said pulley system to a handle device connected with said cable system to move said telescopic members upwardly when the handle device is moved downwardly.

7. The tower of claim 6 wherein counterweights which balance the weight of the second panel are incorporated with said cable so that the second panel is infinitely adjustable and will remain in any vertical position.

8. The tower of claim 7 in which said handle device comprises a crossbar disposed rearwardly of the first panel between counterweights and connected thereto.

9. The tower of claim 8 in which said counterweights have front faces with recessed sockets for receiving said masts and guiding travel upwardly and downwardly thereon.

10. The tower of claim 9 wherein said counterweights have slots adjacent to said sockets in their front faces to receive the cable system; said cable system comprising a pair of cables each attached at one end to a separate counterweight and at an opposite end to said second panel.

11. The tower of claim 5 wherein each of said telescopic members is part of a telescopic assembly received within one of said masts which include a further telescopic member having a telescopic relation with said telescopic member and mast.

12. The tower of claim 11 wherein a vertically reciprocable plunger connects said further telescopic member and telescopic member to move said further telescoping member upwardly when the telescopic member has reached the upper limit of the extending movement of said telescopic member.

13. A method of making a manually operated acoustic shell tower which is assemblable with other such towers to form an orchestral shell, the tower including: a panel assembly having a first panel with front and rear surfaces and sound reflecting and enhancing construction mounted on a counterweighting base, stage engaging supports for the base, a second sound shell panel of sound reflecting and enhancing configuration mounted on said assembly for vertical telescoping movement from a storage position generally horizontally aligned with the first panel upwardly to a raised position in which said second panel extends above the first panel to form a sound reflecting and enhancing upper extension thereof, and a cable operated system for moving said second panel the steps of:

(a) connecting a handle for up and down travel relative to said assembly to said cable operated system; and (b) connecting said second panel and cable operated system such that, when the handle is moved downwardly the second panel is manually raised.

14. The method defined in claim 12 including the step of counterweighting the handle such that said handle counterbalances the weight of said second panel and maintains said second panel in any position to which said second panel is raised.

15. A method of erecting an acoustic shell made up of edge to edge towers in abutting relation, each of the towers including: a panel assembly having a first panel with front and rear surface formed of sound reflecting material mounted on a base, stage engaging roller supports for the base, a second panel formed of sound reflecting material mounted on said assembly for vertical telescoping movement from a storage position generally horizontally aligned with the first panel upwardly to a raised position in which said second panel extends above the first panel to form a sound reflecting and enhancing upper extension thereof, a panel raising and lowering system connected to lower end of said second panel, a handle mounted for up and down travel relative to said assembly, and a connection between said raising and lowering system and said handle, the steps of:

(a) rolling the towers to a position in edge abutting relation to form the shell and telescopically elevating the second panel of each to an elevated position by pushing downwardly on the handle of each.

16. The method defined in claim 15 wherein the handle is counterweighted such that said handle counterbalances the weight of said second panel and maintains said second panel in any position to which said second panel is raised.

17. In an easily raisable and lowerable acoustic shell tower, the combination comprising:

(a) a sound shell tower panel assembly having a first panel with front and rear surfaces and sound reflecting and enhancing construction and configuration;

(b) said assembly including a base mounted to and counterweighting said first panel;

(c) stage engaging supports mounted on said base;

(d) a movable second sound shell panel having sound reflecting and enhancing construction and upper and lower portions, mounted on said base for vertical movement from a demounted position generally horizontally aligned with said lower panel upwardly to a raised position in which said second panel extends above said first panel to form a sound reflecting and enhancing upper extension thereof; and (e) a cable and pulley system for moving said second panel, including a pulley mounted on said base and a cable trained therearound and connected to the lower portion of said second panel.

18. The acoustic shell tower of claim 17 wherein a handle connected to said cable is counterweighted to balance the weight of said second panel to retain said second panel in any selected raised position.

19. In an easily raisable and lowerable acoustic shell tower, the combination comprising:

(a) a sound shell tower panel assembly having a first panel with front and rear surfaces and sound reflecting and enhancing construction;

(b) said assembly including a base for counterweighting said first panel;

(c) stage engaging supports provided on said base;

(d) a movable second sound shell panel having sound reflecting and enhancing configuration and construction, mounted on said base for vertical movement from a demounted position generally horizontally aligned with said lower panel upwardly to a raised position in which said second panel extends above said first panel to form a sound reflecting and enhancing upper extension thereof;

(e) raising mechanism connected to said second sound shell panel for moving said second panel upwardly; and (f) a counterweight system connected to said raising mechanism for retaining said second panel in raised position, said counterweight system being weighted to exactly counterbalance the weight of said second panel.

20. The shell tower of claim 19 wherein said counterweight system has a counterweight which is guided for vertical movement on said base.

* * * * *

UNITED STATES PATENT AND TRADEMARK OFFICE

CERTIFICATE OF CORRECTION

PATENT NO. : 5,403,979

DATED : April 4, 1995

INVENTOR(S) : Orley D. Rogers and James F. Jenne

It is certified that error appears in the above-indentified patent and that said Letters Patent is hereby corrected as shown below:

Column 6, line 41, change "12" to -- 13 --; line 58, after "to" insert -- the --.

Signed and Sealed this

First Day of August, 1995

*Attest:*

*Attesting Officer*

BRUCE LEHMAN

*Commissioner of Patents and Trademarks*